US006796832B2

(12) United States Patent
Andrieu et al.

(10) Patent No.: US 6,796,832 B2
(45) Date of Patent: Sep. 28, 2004

(54) ELECTRICAL POWER OUTLET FOR A MOTOR VEHICLE COMPRISING AN INTEGRATED ILLUMINATION DEVICE

(75) Inventors: Michel Andrieu, Bobigny Cedex (FR); Michel Lau, Bobigny Cedex (FR); Philippe Rostan, Bobigny Cedex (FR)

(73) Assignee: Valeo Vision, Bobigny Cedex (FR)

( * ) Notice: Subject to any disclaimer, the term of this patent is extended or adjusted under 35 U.S.C. 154(b) by 0 days.

(21) Appl. No.: 10/109,229

(22) Filed: Mar. 27, 2002

(65) Prior Publication Data

US 2002/0197909 A1 Dec. 26, 2002

(30) Foreign Application Priority Data

Mar. 27, 2001 (FR) ..... 01 04216

(51) Int. Cl.[7] ..... H01R 13/60
(52) U.S. Cl. ..... 439/535; 439/653
(58) Field of Search ..... 439/535, 638, 439/639, 653, 536, 699.2, 36, 34, 56, 538, 558; 174/48

(56) References Cited

U.S. PATENT DOCUMENTS 1,274,552 A * 8/1918 Hubbard et al. ..... 439/653
1,314,218 A * 8/1919 Rodrigues ..... 340/656
1,634,404 A * 7/1927 Douglas ..... 200/51.12
1,722,886 A * 7/1929 Beck ..... 362/296
2,684,470 A * 7/1954 Cataldo ..... 439/653
5,007,863 A 4/1991 Xuan ..... 439/639
5,536,175 A * 7/1996 Forish ..... 439/57

FOREIGN PATENT DOCUMENTS

| | | |
|---|---|---|
| DE | 40 41 886 A1 | 7/1992 |
| EP | 1 033 791 A2 | 9/2000 |
| JP | 07-085934 | 3/1995 |

OTHER PUBLICATIONS

French Search Report, Jan. 11, 2002.

* cited by examiner

*Primary Examiner*—Tho D. Ta
(74) *Attorney, Agent, or Firm*—Morgan & Finnegan, LLP

(57) ABSTRACT

The invention provides an electrical power outlet, especially for connecting, to the electrical circuit of a motor vehicle, an appliance or an accessory comprising a male plug which is the complement of the outlet, of the type comprising a body made of an insulating material which comprises a cylindrical container of vertical axis capable of accommodating the body which is the complement of the male plug, and which bears means for electrically connecting the outlet to an electrical power circuit of the vehicle, wherein the insulating body comprises a cavity for an illumination lamp, and bears means for electrically connecting the lamp to an electrical circuit of the vehicle.

17 Claims, 21 Drawing Sheets

ELECTRICAL POWER OUTLET FOR A MOTOR VEHICLE COMPRISING AN INTEGRATED ILLUMINATION DEVICE

The present invention relates to an electrical power outlet intended to equip a motor vehicle.

More particularly, the invention relates to an electrical power outlet for connecting, to the electrical circuit of a motor vehicle, an appliance or an accessory comprising a male plug which is the complement of the outlet.

The most widespread conventional arrangement of a power outlet of this sort is that of the cigarette lighter outlet in the passenger compartment of the vehicle, the male plug then incorporating a heating element powered by the electrical outlet.

However, it is found that more and more vehicles are being equipped with different power outlets which are arranged at various locations of the vehicle, such as the boot, doors, glove boxes, etc.

This multiplication of electrical power outlets allows the connection of various appliances or accessories which must be powered by a current with the possibility of sometimes high electrical consumption.

Such accessories are in particular mobile telephones, components belonging to an acoustic device in the passenger compartment, appliances for cleaning by suction, etc.

According to a known design of a power outlet, it mainly consists of a body made of an insulating material which comprises a cylindrical container capable of accommodating the body which is the complement of the male plug, and which bears means for electrically connecting the outlet to an electrical power circuit of the vehicle.

An outlet of this sort is fitted by virtue of a cut-out or window formed in a panel of the vehicle, the outline of which is the complement of that of the insulating body, the outlet comprising a connector in order to connect it with a complementary connector belonging to a branch of the electrical harness of the vehicle.

Fitting a power outlet therefore requires electrical assembly and connection operations.

Moreover, it is found that such power outlets are fitted in regions of the vehicle which also comprise devices for illuminating this region.

An illumination device of this sort comprises a casing with a lamp, the casing being mounted in a cut-out in a panel of the region and comprising a connector for connecting the lamp to another branch of the electrical harness of the vehicle.

Thus, the fitting of a power outlet and of an illumination device in the same region of the vehicle involves a large number of components and leads to mounting and connection operations which are complex and many.

In order to overcome these drawbacks, the invention provides an electrical power outlet characterized in that the insulating body comprises a cavity for an illumination lamp, especially for powerful illumination of a region of the vehicle, and bears means for electrically connecting the lamp to an electrical circuit of the vehicle.

According to other characteristics of the invention:

- the container of the insulating body is internally lined with a fixed contact sleeve and bears a first conducting strip which connects the sleeve to a first pin of a connector;
- the insulating body bears a fixed contact pad arranged at the centre of the container and a second conducting strip which connects the central contact pad to a second pin of a connector;

- the bottom of the cavity comprises a socket with two opposite poles, which accommodates the cap of the lamp;
- the insulating body bears two conducting strips which connect the two poles of the socket to two pins of a connector;
- the electrical outlet comprises a common connector for connecting the outlet and the lamp;
- the common connector is a three-pin connector, the first conducting strip connects one of the poles of the socket to the first pin of the common connector, and the insulating body bears a third conducting strip which connects the other pole of the socket of the lamp to a third pin of the common connector;
- the pins of the common connector are borne by an insulating support made as a single part with the insulating body;
- the pins of the common connector are borne by an insulating support attached to the insulating body;
- each pin of the connector consists of a free end of the associated conducting strip;
- each connector pin is borne by the insulating support attached to the common connector and is electrically connected to a tab of the associated conducting strip;
- the insulating body is a part moulded from plastic which incorporates the container and the cavity;
- the insulating body comprises means of positioning and fastening the conducting strips;
- the insulating body comprises an upper horizontal plate for assembling the outlet into which the container opens;
- the cavity comprises an open face, away from the said bottom, through which the light flux from the lamp emerges;
- the open face of the cavity opens out into the assembly plate of the insulating body;
- the electrical outlet comprises an integrated switch for controlling the lamp;
- the third strip is made in two sections between which the switch is inserted;
- the electrical outlet comprises an articulated lid for closing the container;
- the lid is an articulated closing flap, held elastically in the closed position in which it lies substantially in the plane of the upper assembly plate.

Other characteristics and advantages of the invention will become apparent on reading the following detailed description for the understanding of which reference may be made to the appended drawings in which.

In the following description, identical, similar or analogous components will be denoted by the same reference numbers By way of non-limiting example, in order to facilitate understanding of the description and of the claims, a vertical (V), longitudinal (L) and transverse (T) orientation will be adopted according to the reference V, L, T indicated in the figures.

Figure 1:
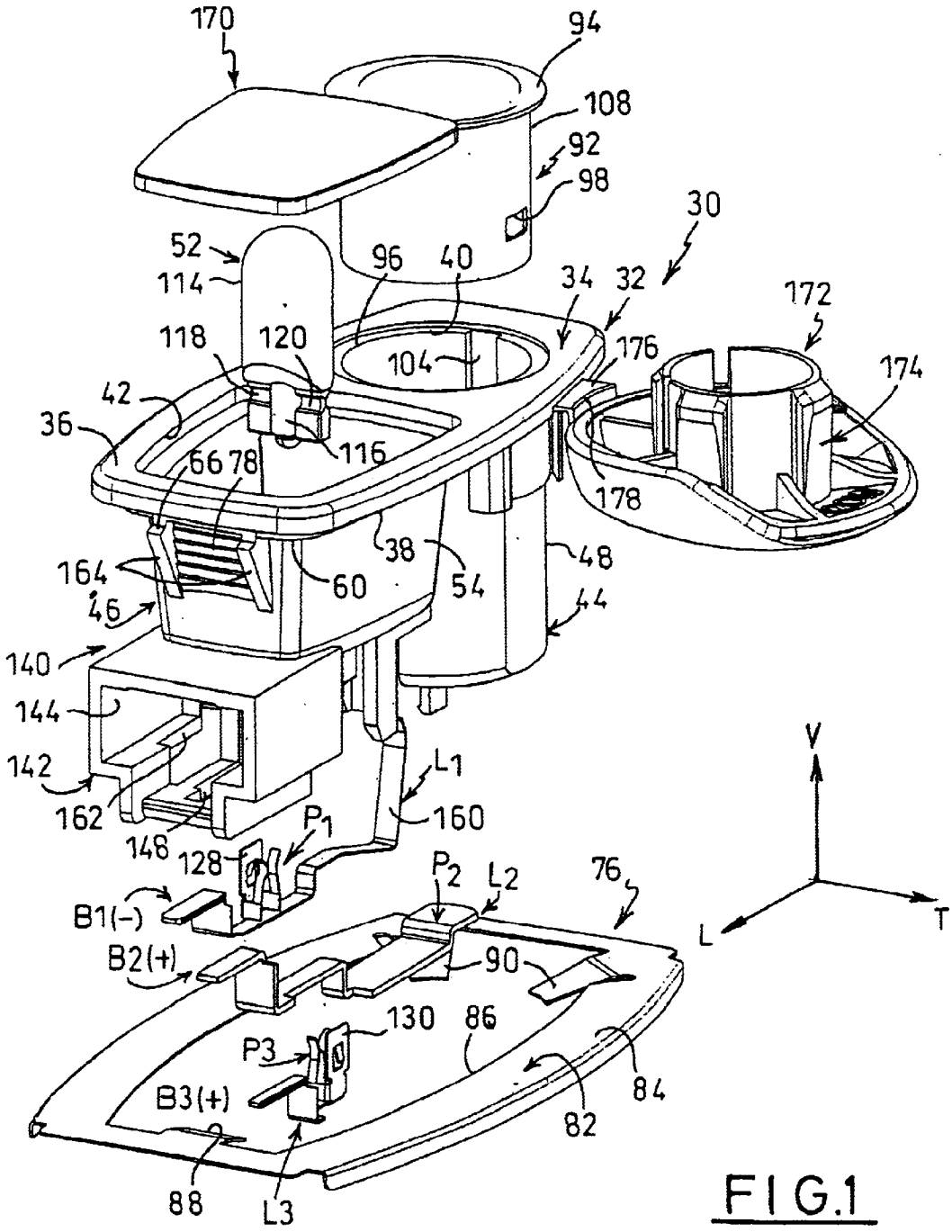
FIG. 1 is a perspective view of the various components of a first embodiment of a power outlet incorporating an illumination device according to the teachings of the invention.
Figure 2:
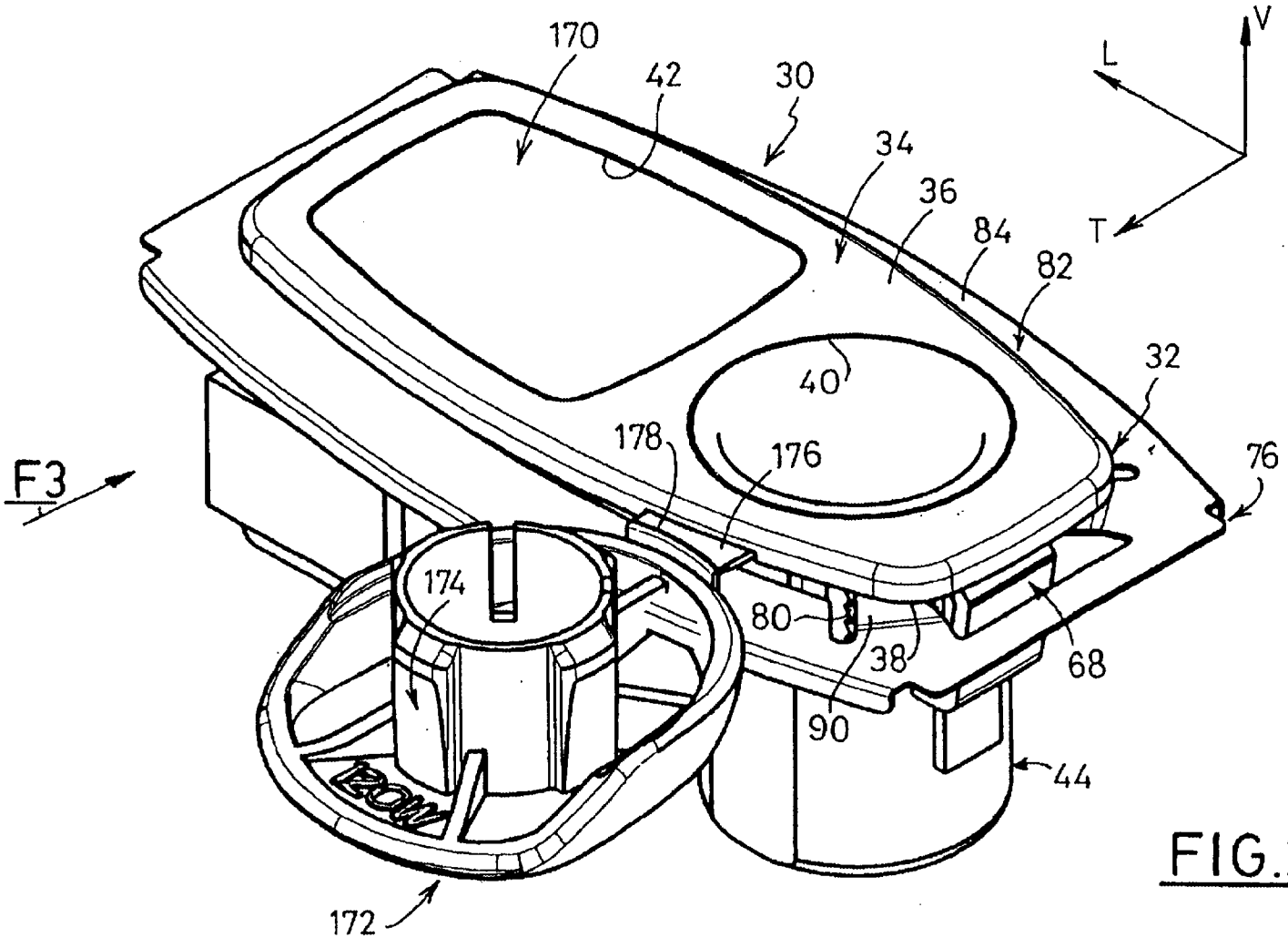
FIG. 2 is a perspective view of the outlet of FIG. 1 which is shown with its components assembled and its outlet lid in the open position.
Figure 3:
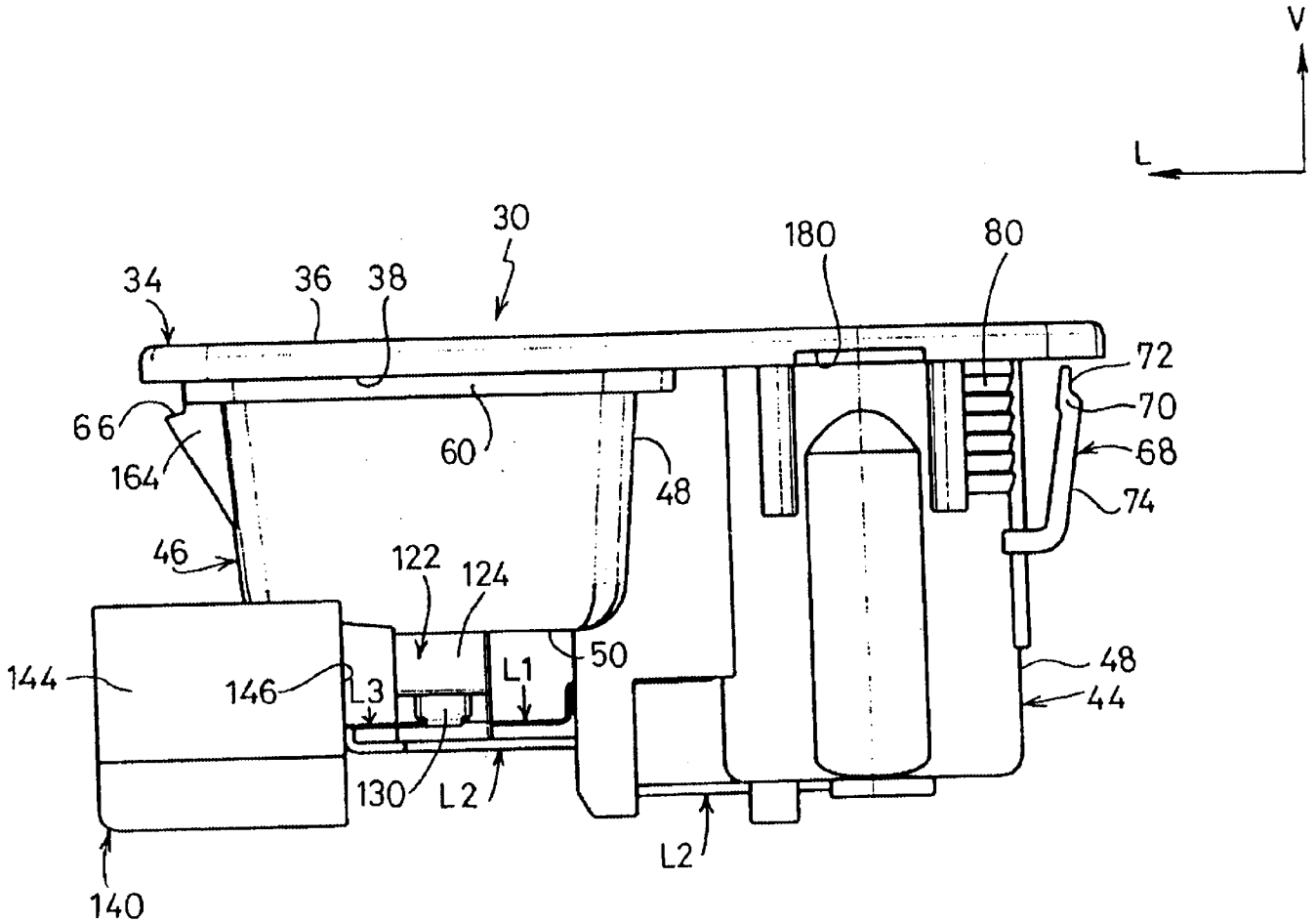
FIG. 3 is a lateral view along the arrow F3 of FIG. 2, without the lid.
Figure 4:
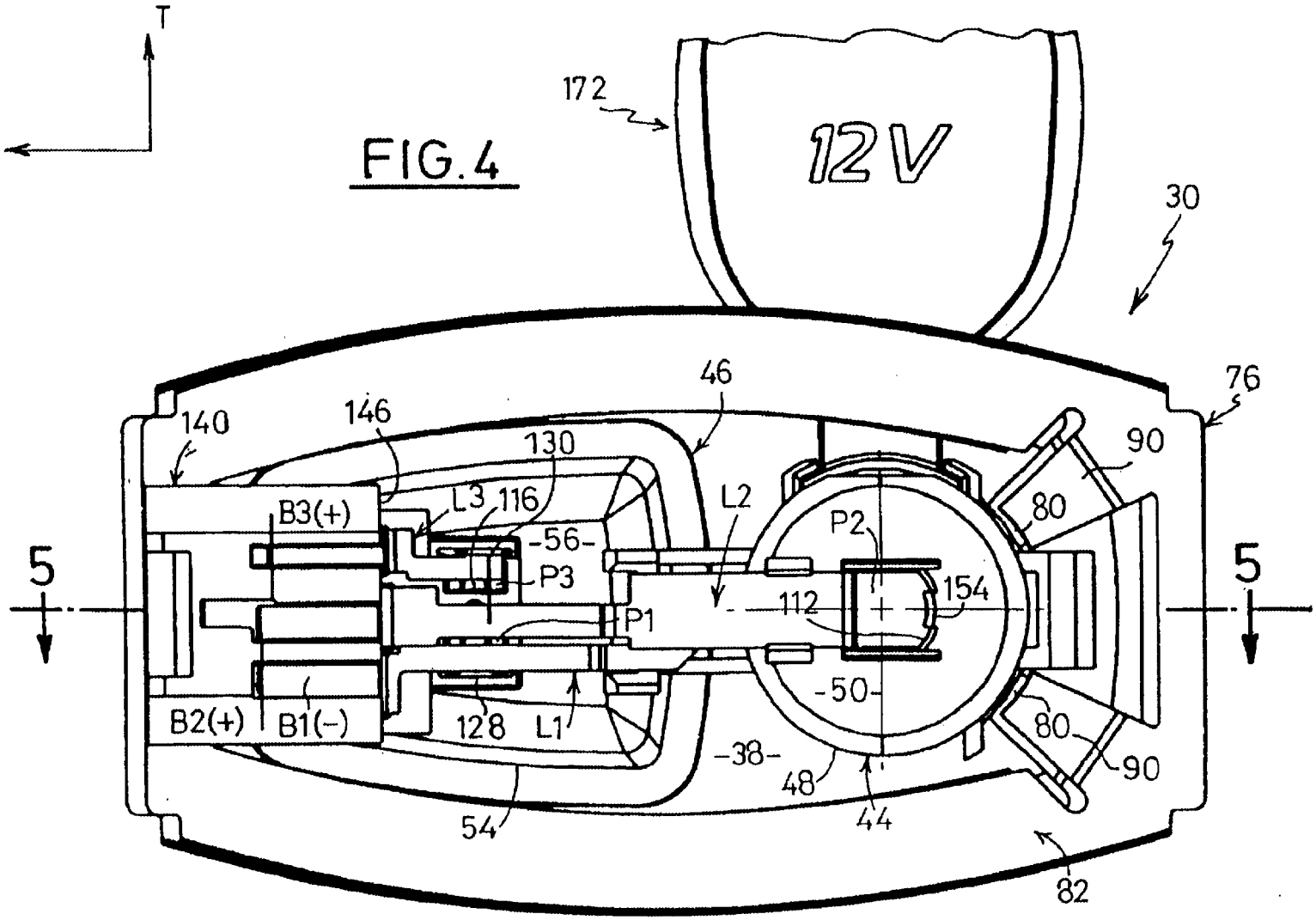
FIG. 4 is a bottom view of the outlet shown in FIG. 2.

Similarly, the terminology front, rear, left and right will be adopted with reference to the figures, and especially to FIG. 1 which is a perspective right front three-quarters view.

An electrical power outlet 30, which mainly consists of a body 32 made by moulding a plastic, is shown in FIGS. 1 to 6.

The insulating body 32 comprises an upper horizontal assembly plate 34 delimited by upper 36 and lower 38 faces, which comprises a circular opening 40 and a substantially rectangular opening 42 which extend respectively downwards by means of a container 44 of the power outlet and by means of a cavity 46 of an illumination device which is incorporated, according to the teachings of the invention, into the power outlet.

By way of variant, the opening may take any other shape, and in particular a circular shape.

The plate or platen 34 is of substantially rectangular shape oriented in the longitudinal direction and, in the embodiments illustrated in the figures, the openings 40 and 42 are adjacently placed in the longitudinal direction so as to provide a highly compact unit.

According to a known general design, the container 44 is in the shape of a cylindrical pot of vertical axis A1 and is especially delimited by a cylindrical skirt 48 and by a lower horizontal bottom 50.

The cavity 46 of the illumination device which accommodates a lamp 52, here with a general vertical axis A2, is of an overall parallelepipedal rectangle shape delimited by a peripheral lateral wall 54 and by a horizontal lower bottom 56.

Under its lower face 38, the upper plate 34 comprises a peripheral shoulder 60, mainly around the cavity 46, the outline of which is the complement of that of a cut-out 62 formed in a panel 64 of part of the motor vehicle and in which the outlet 30, integrating the lamp 52, is mounted.

Figure 5:
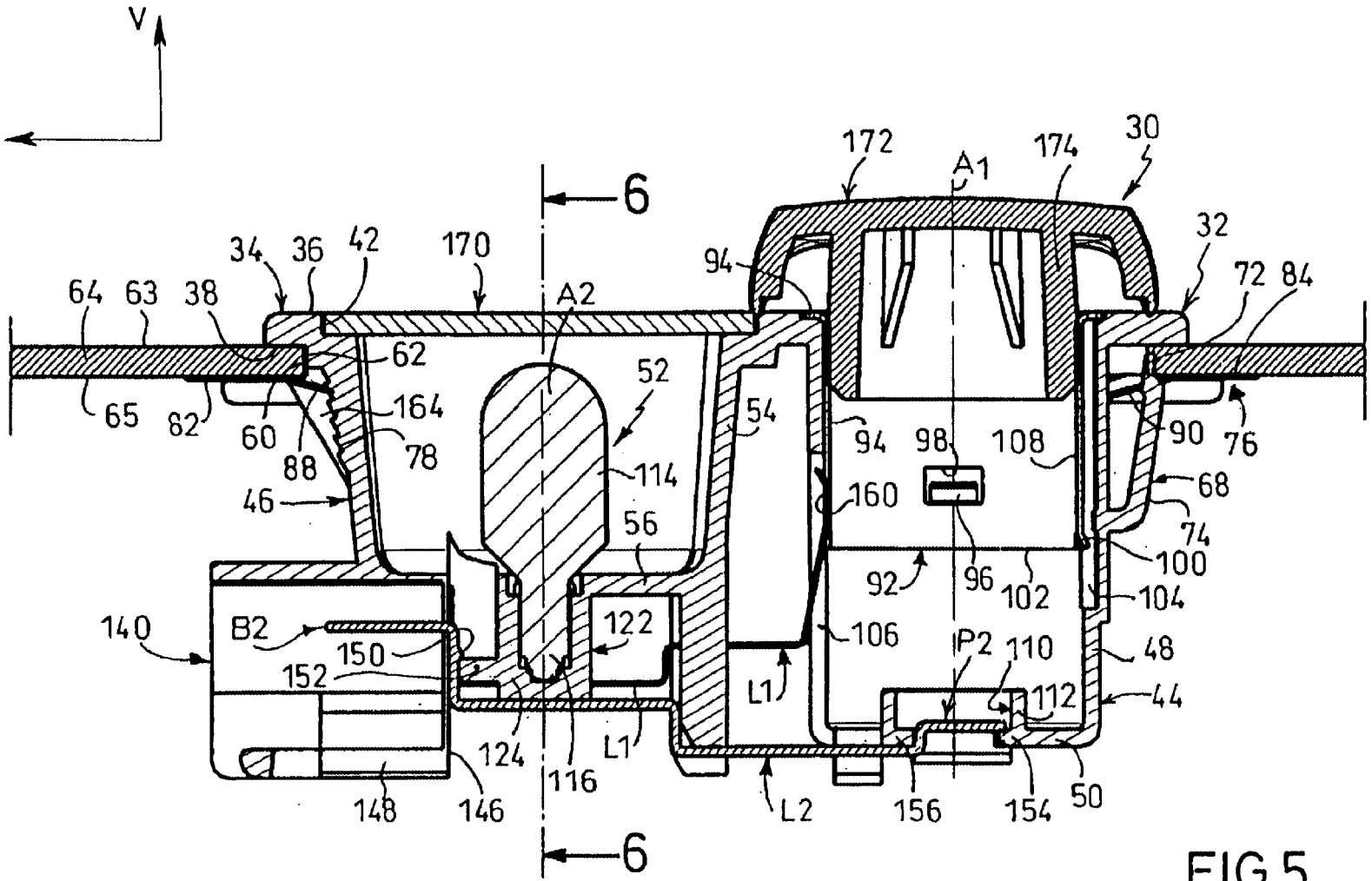
FIG. 5 is a view in longitudinal section, along the line 5—5 of FIG. 4, with the lid in the closed position, and in which the outlet is shown in the mounted position in a panel of the vehicle.
Figure 6:
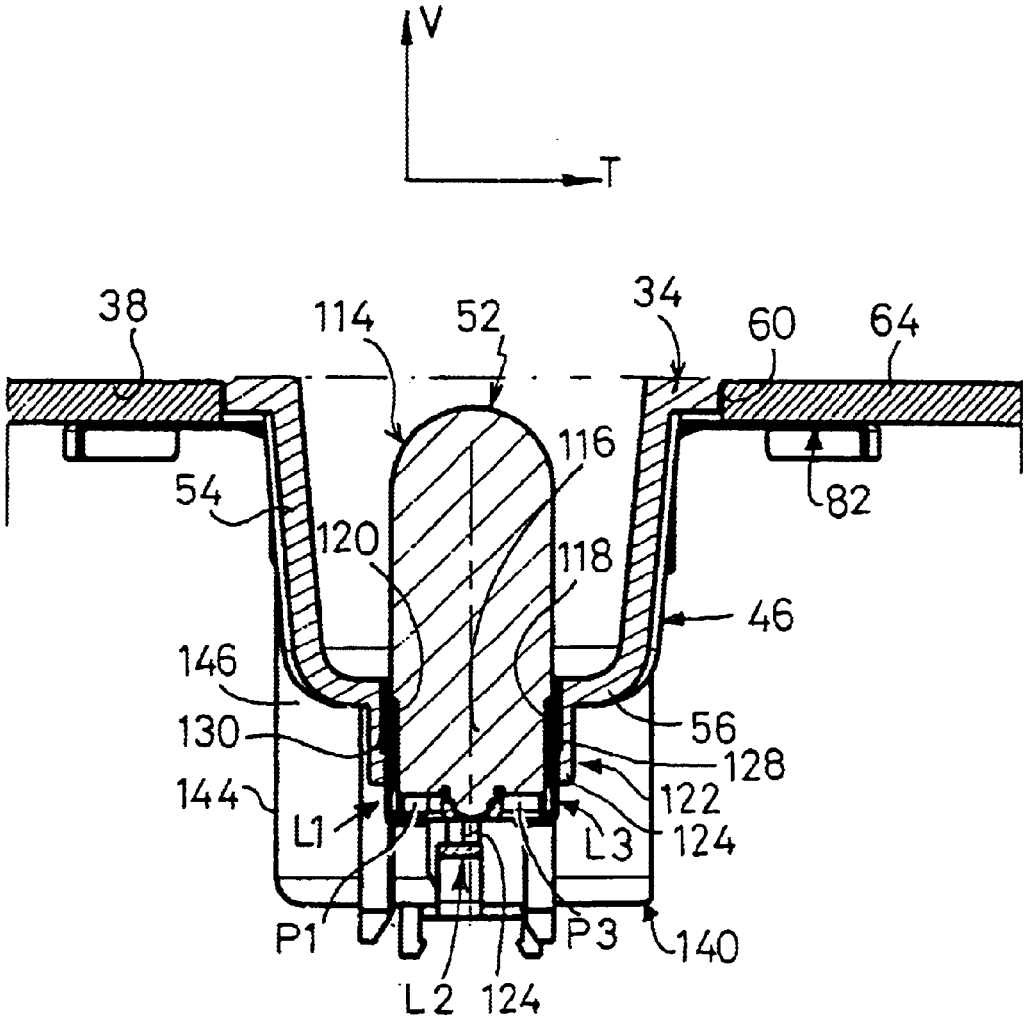
FIG. 6 is a view in transverse section along the line 6—6 of FIG. 5.
Figure 7:
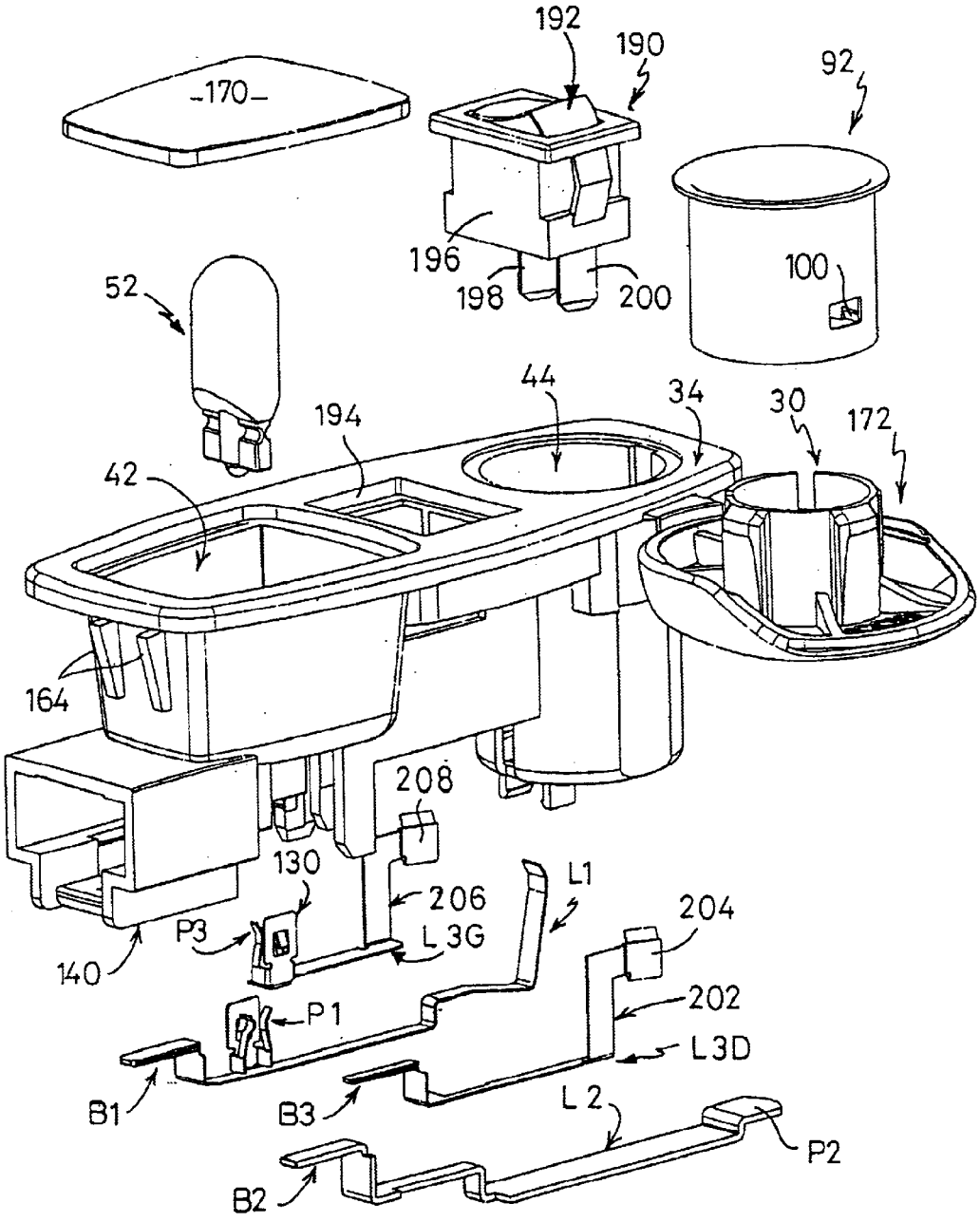
FIGS. 7 to 11 are views similar to those of FIGS. 1 to which illustrate a second embodiment of an outlet according to the invention which incorporates a switch for controlling the illumination device.
Figure 8:
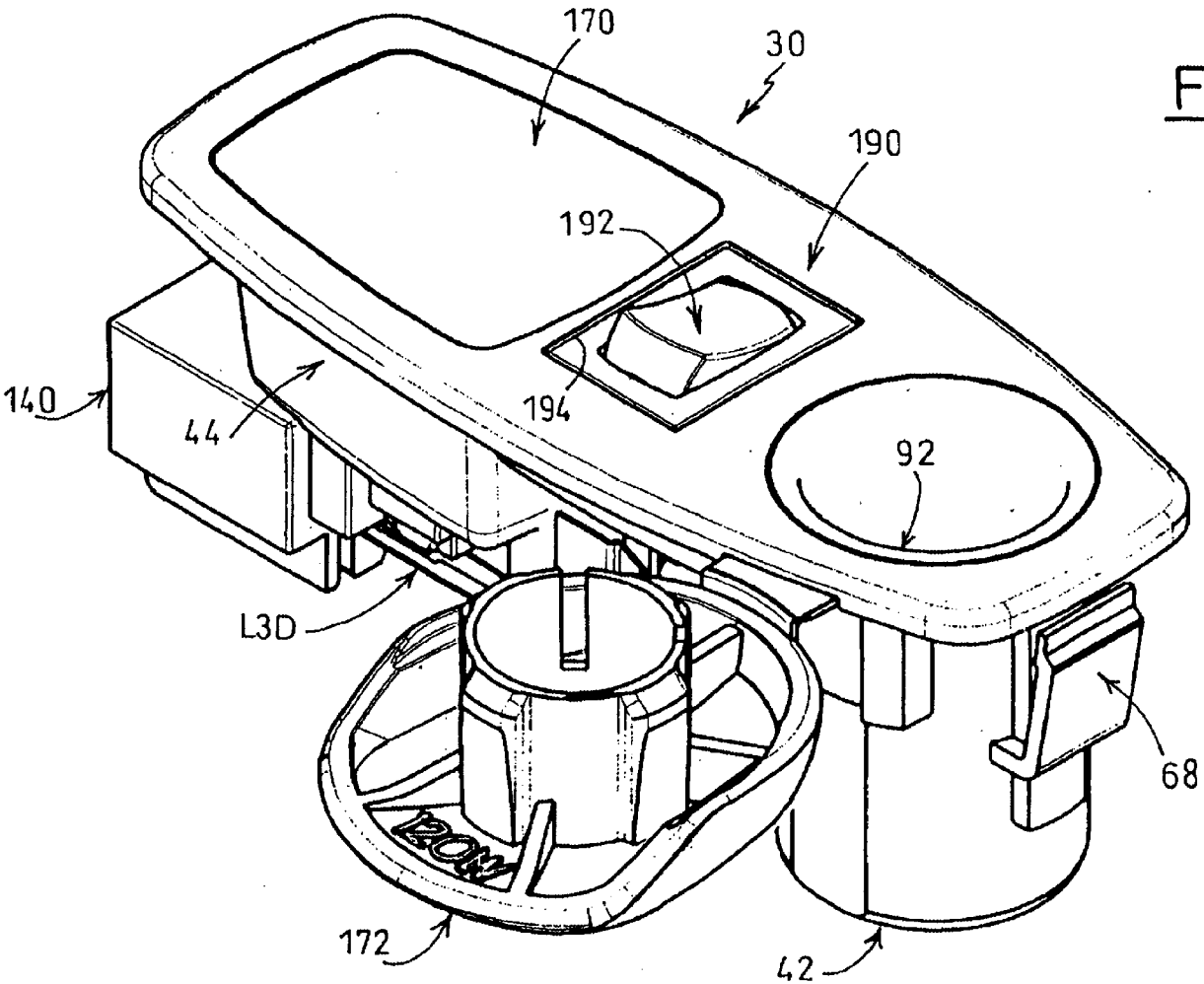
Figure 9:
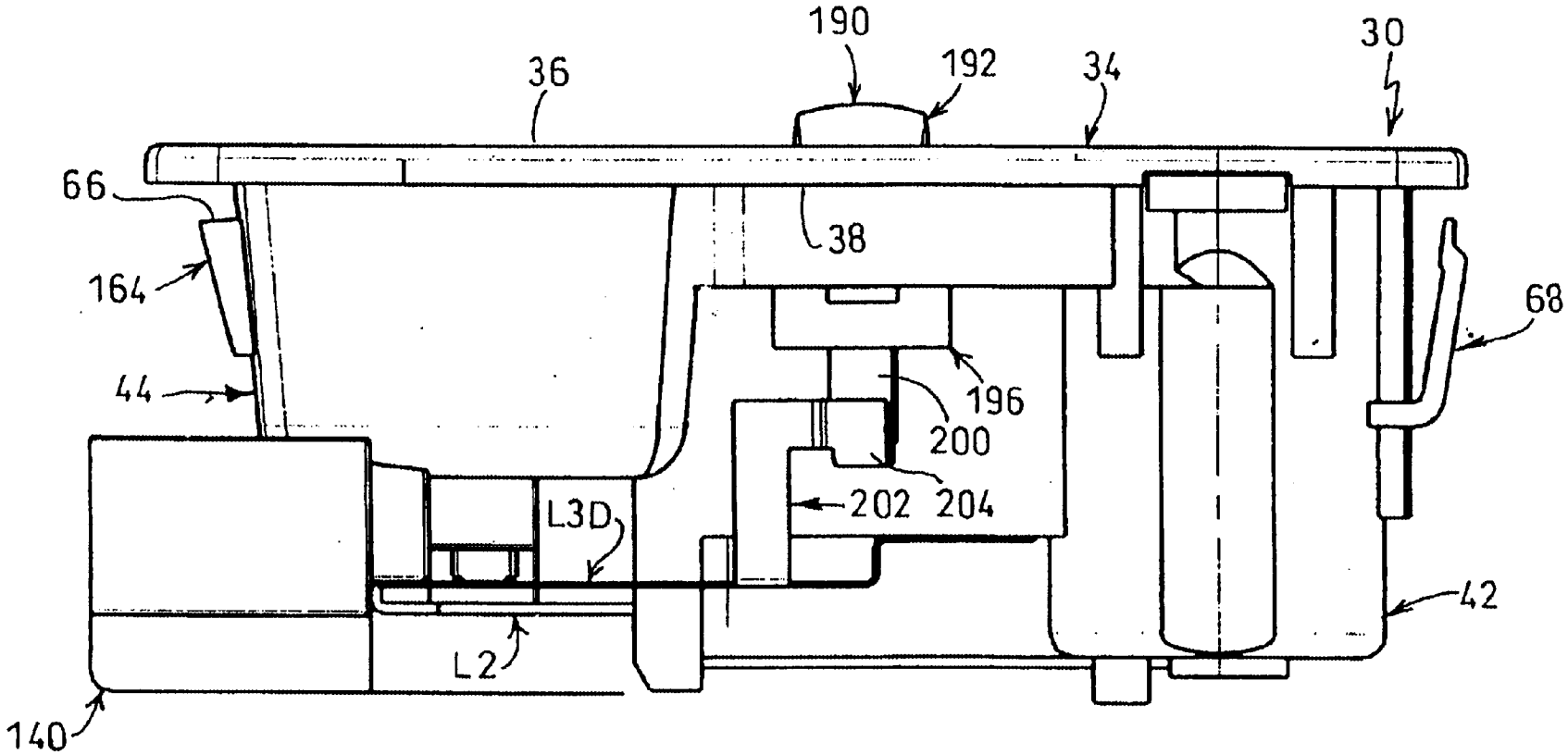
Figure 10:
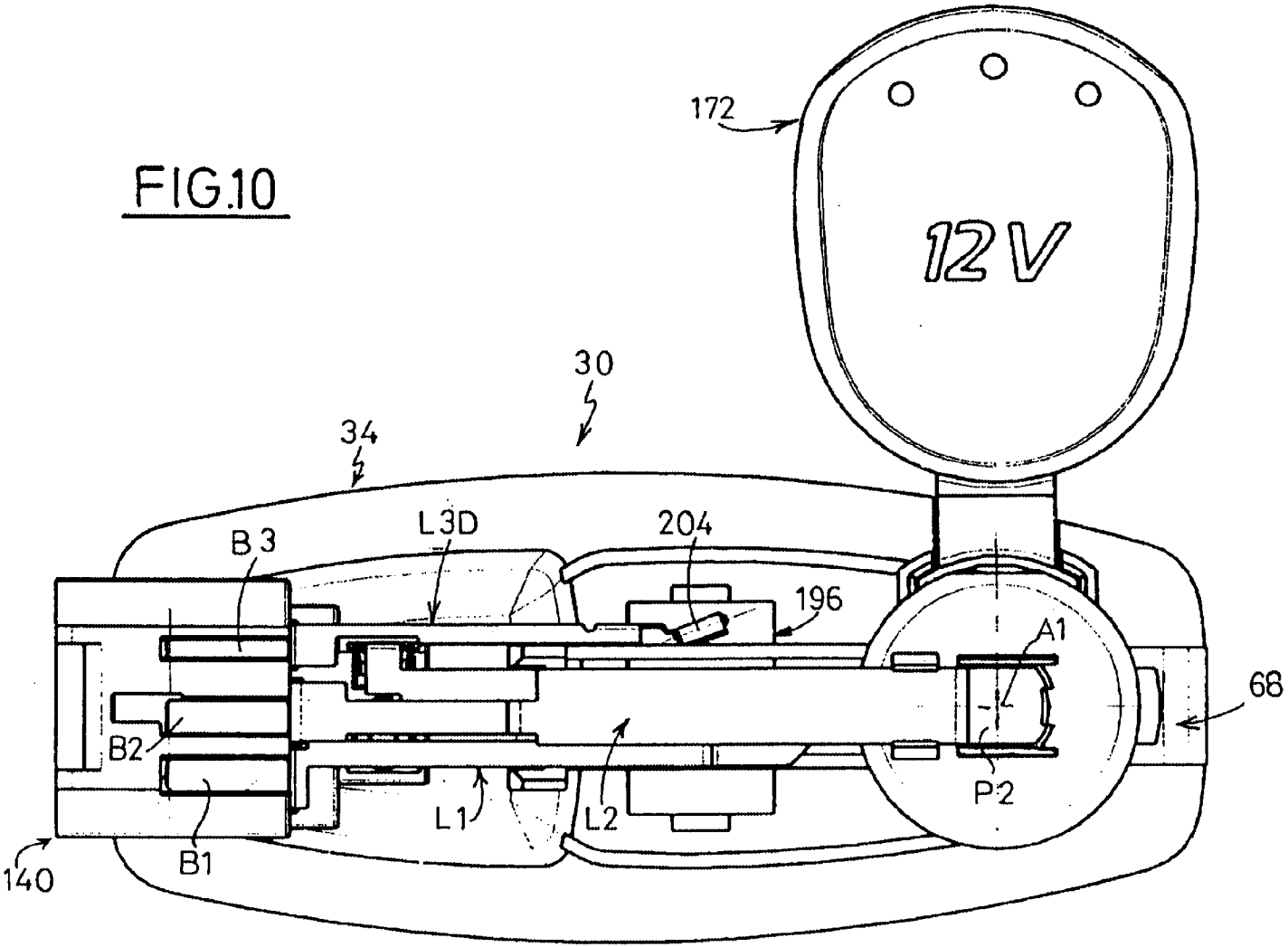
Figure 11:
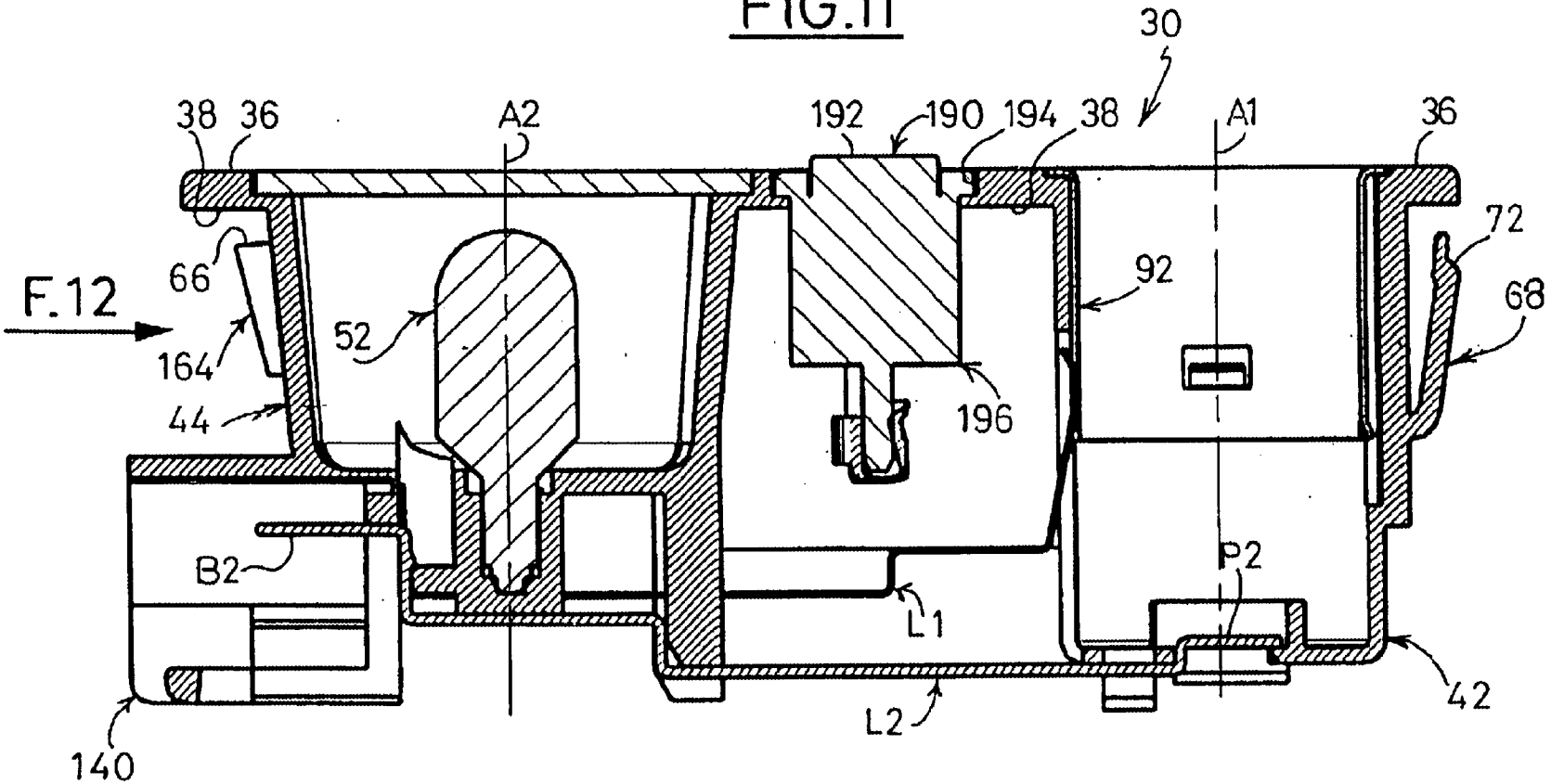
Figure 12:
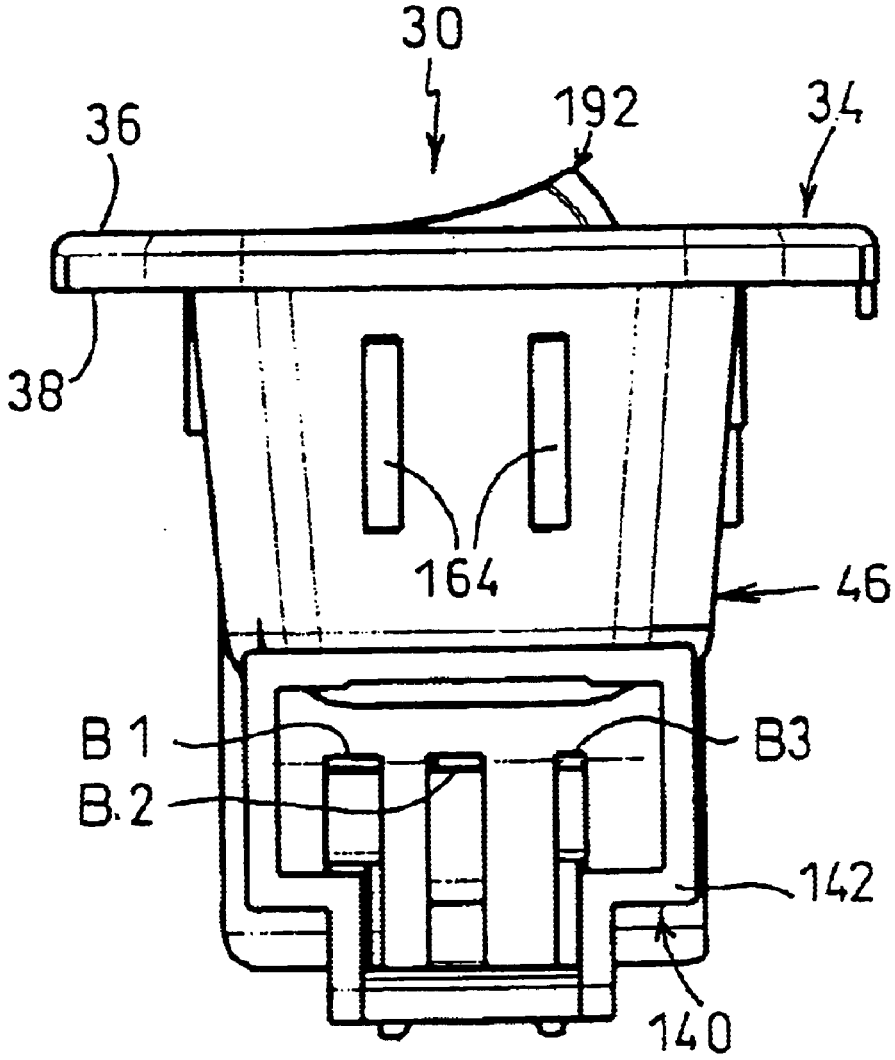
FIG. 12 is a longitudinal end-on view along the arrow F12 of FIG. 11.

To keep the outlet 30 vertically in the assembled position in the cut-out 62, the insulating body 32 comprises two ribs 164 of vertical and longitudinal orientation formed outside the wall 54 and each of which is delimited by an upper shoulder 66 extending below the lower face 38 at a distance which, as can be seen in FIG. 5, corresponds substantially to the thickness of the panel 64.

Away from the ribs 164, and as can be seen in the right part of FIG. 5, the body 32 comprises an elastically deformable tab 68 which is moulded with the lateral wall 48 of the container 44 and which extends generally vertically upwards with its upper free end 70 which delimits a notch or lip 72 located facing the lower face 38.

Thus, this design allows the easy and economic assembly of the outlet 30 by introducing the edge of the cut-out 62 from the side of the ribs 164, then by generally tilting vertically downwards in order to introduce the tab 68 which is elastically deformed by virtue of its outer face forming a ramp which co-operates with the edge corresponding to the cut-out until its notch 72 interlocks under the cut-out.

This method of attachment allows the outlet 30 to be dismantled by elastically deforming the tab 68.

It is of course necessary that the vertical distance separating the lower face 38 from the shoulders 66 and from the notch 72 corresponds substantially to the thickness of the panel 64.

The number and the position of the ribs 164 and of the tabs 68 may vary depending on the application, and especially depending on the interlocking forces, the value of which is determined by the specifications of the client incorporating the outlet in a panel.

The body 32 shown in FIGS. 1 to 6 also allows the outlet 30 to be assembled by means of the lower peripheral clip 76, in panels of different thicknesses, especially when it involves a is panel coated externally with a fabric or with a covering carpet.

For this purpose, the front transverse face of the lateral wall 54 of the container 46 comprises a series of notches 78 formed between the ribs 164, while the rear longitudinal part of the lateral wall 48 of the container 44 comprises, on each side of the elastic tab 68, similar notches 80.

The clip 76 is a cut and folded sheet-metal part which mainly consists of a peripheral collar 82, the upper face 84 of which is plane and horizontal in order to bear under the lower face 65 of the panel 64.

The internal outline 86 of the collar 84 comprises a front elastic lug 88 which extends facing the notches 78 and two rear lugs 90 which extend facing the notches 80.

With reference to FIG. 5, it is understood that, after having put the insulating body 32 in place in the cut-out 62, the panel 64 is clasped between the lower face 38 of the plate 34 and the upper face 84 of the collar 82 with snap-fastening of the lugs 88 and 90 into the notches 78 and 80.

As is shown in FIG. 5, the clip 76 may be used in combination with assembly by snap-fastening of the tab 68, in order to prevent any accidental dismantling, or indeed it may be used when the thickness of the panel 64, delimited by its upper 63 and lower 65 faces, is greater or smaller, the tab 68 then no longer having a fastening function, the latter being provided by the clip 76 alone.

The power outlet 30 mainly consists of the container 44 which internally accommodates a metal tubular sleeve 92 which internally lines the inner cylindrical wall 94 of the skirt 48 in the upper part thereof, the sleeve comprising, at its upper end, a horizontal collar 94 which is supported in a counterbore 96 of the opening 40 in order to position it in its assembled position in which it is immobilized by lugs 96 of the wall 94 accommodated in recesses 98 of the sleeve.

The sleeve 92 is angularly oriented about the axis A1 with respect to the container 44 by virtue of a lug 100, cut out from the sleeve 92 near to its lower edge 102, which projects radially outwards and which is accommodated in a groove 104 formed in the wall 94 which is open vertically upwards in order to allow the lug 100 to pass through when the sleeve 92 is put in place in the container 44.

As can be seen in FIG. 5, the rear part (to the left) of the lateral wall 48 of the container 44 comprises a vertical slot 106 facing the lateral wall 54 of the cavity 46, which extends over part of the height and which forms a passage, allowing, as will be explained below, an electrical connection with the cylindrical and conducting external lateral face 108 of the sleeve 92.

The bottom 50 of the container 44 comprises a central hole 110, delimited laterally by a tubular collar 112 of vertical axis which projects inside the container 44, and to which a fixed contact pad P2 belonging to a conducting strip L2 is fitted.

The fitting and the positioning of the sleeve 92 and of the fixed pad P2 are such that they allow their electrical connection with the complementary means of a standardized male outlet (not shown in the figures).

Thus, the sleeve 92 is especially partly defined by the standard SAE J563.

The collar 112 makes it possible to prevent any metal object that might fall into the container 44 from causing an accidental short circuit between the sleeve 92 and the pad P2 and thus destroying the fuse equipping the corresponding electric circuit of the vehicle.

The lamp 52 is, in this case, by way of non-limiting example, of the W5W type and it conventionally comprises a body or bulb 114 and a lower cap 116 which comprises two contacts or terminals 118, 120, each one of which is provided in order to be connected to a contact pad P1, P3, respectively, belonging to a socket 122 for assembling the cap 116 of the lamp which is incorporated into the bottom of the cavity 46.

The socket 122 thus comprises an insulating body 124, produced integrally by moulding with the bottom 56, below the latter and it houses two pairs of fixed contact pads P1 and P3, each one of which belongs respectively to a first electrical connection strip L1 and to a third electrical connection strip L3 (see FIG. 1).

In the embodiment illustrated in the figures, each pair of pads P1, P3 in this case has the shape of a fork which, when the lamp 52 is in place, clasps the corresponding terminal 118, 120.

However, the invention is in no way limited to this type of lamp and to this configuration of the pads P1 and P3, it being possible for the lamp to be of any type and especially an LED, the pads P1, P3 of the socket 122 being of a design and of a shape matched to the cap 116 of the lamp.

The pads P1 and P3 are put in place vertically upwards in the insulating body 124 of the socket 122 and they are retained there by virtue of associated dogs 128 and 130, respectively, which are produced integrally with the pads P1, P3 of the strips L1 and L2, by cutting and folding, and which are accommodated in complementary slots of the insulating body 124 of the socket 122 thereby retaining the strips L1 and L3 vertically in position.

Each electrical connection strip L1, L2 and L3 and the connector common to the power outlet and to the illumination device which are integrated into the insulating body 32 will now be described.

The second strip L2 is the power strip which connects the is central fixed pad P2 to a pin B2 of the connector which is itself provided in order to be connected to the electrical circuit device of the vehicle.

Because of the high power likely to be supplied by the outlet, for example of the order of 120 W, the strip L2 is cut and folded from thick sheet metal and its two front and rear opposed longitudinal ends form respectively the fixed central pad P2 and the pin B2 of the common connector.

The insulating body 142 of the connector 140 is, in this case, produced integrally by moulding with the insulating body 32 and it has an overall parallelepipedal rectangle shape with a horizontal orientation, being located at the front longitudinal end under the cavity 46.

The body 142 is delimited by a lateral wall 144 of rectangular outline and by a rear transverse and vertical bottom 146.

The rear wall 146 comprises an opening 148 in the form of a vertical and longitudinal slot for the passage of the pin B2, the strip L2 being retained in position with its orientation generally horizontal by virtue of a lug 150 which is elastically interlocked above a complementary shape 152 of the body of the socket 122, and by the interlocking of the rear free end forming the fixed pad P2 in shapes 154 and 156 at the bottom 50 of the container 44.

The first conducting strip L1 provides the connection to the negative pole of the electrical circuit of the vehicle, that is to say to earth, and it is cut and folded from sheet metal of smaller thickness than that of the strip L2, with its rear free end 160 which is folded vertically upwards and elastically deformable in order to come into bearing contact with the outer surface of the sleeve 92, through the slot 106, as can be seen in FIG. 5.

At its other end, the first strip L1 comprises a horizontal longitudinal pin B1 belonging to the connector 140.

The pin B1 enters longitudinally into the insulating body 142 by virtue of an opening 162 provided for this end (see FIG. 1).

The strip L1 is fastened in position by the dog 128, in the same way as the third strip L3, which is fastened by the dog 130.

The design of the third strip L3 is similar to that of the first strip L1, but it only connects the pad 120 of the lamp 52 to a positive wire of the circuit, having for this purpose a third pin B3 made as a single part with the strip L3 and which enters the body of the connector 140 in the same way as the pin B1.

Figure 13:
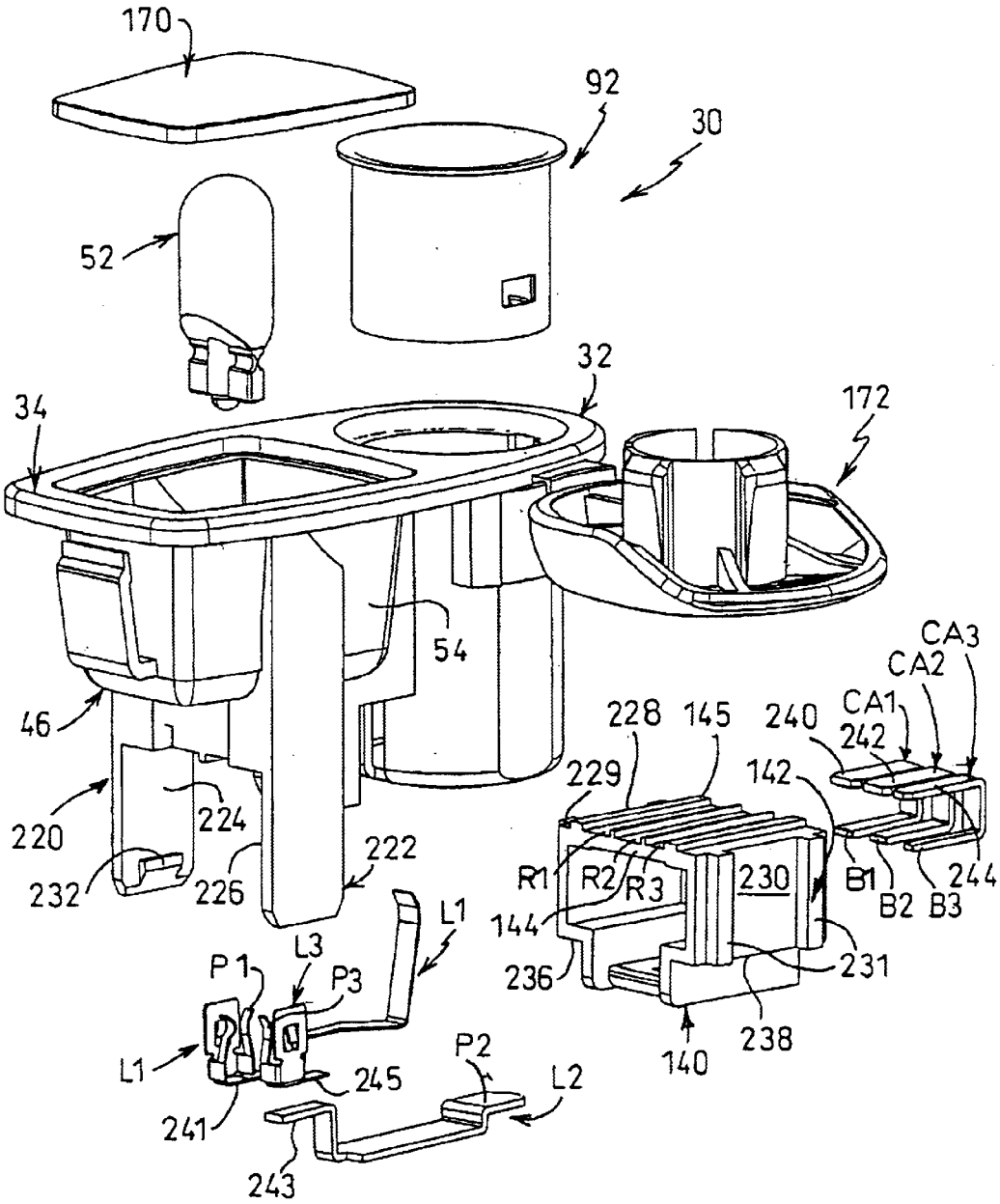
FIGS. 13 to 18 are views similar to those of FIGS. 1 to 6 which illustrate a third embodiment of an electrical power outlet according to the invention with a modular design of the common connector.
Figure 14:
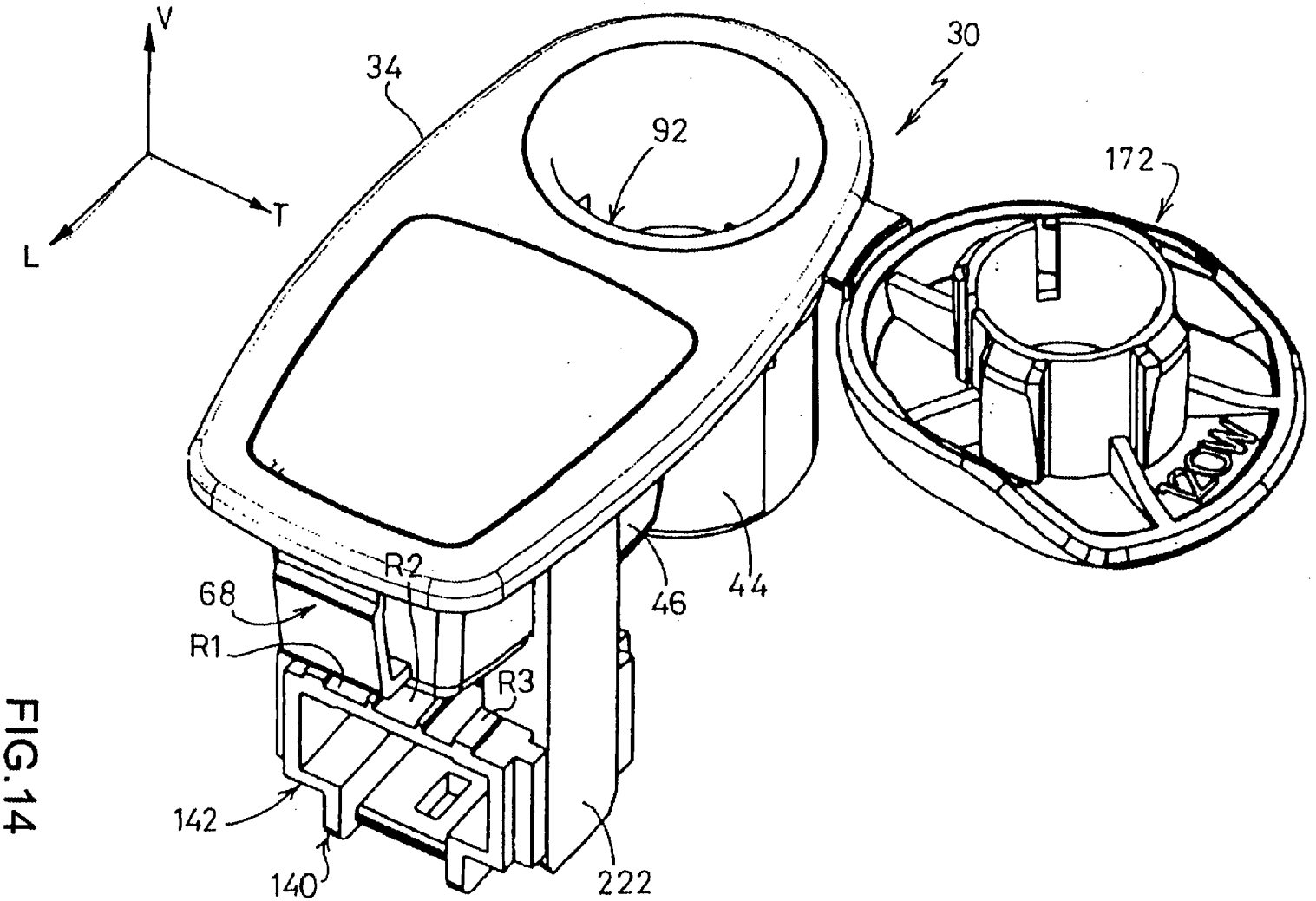
Figure 15:
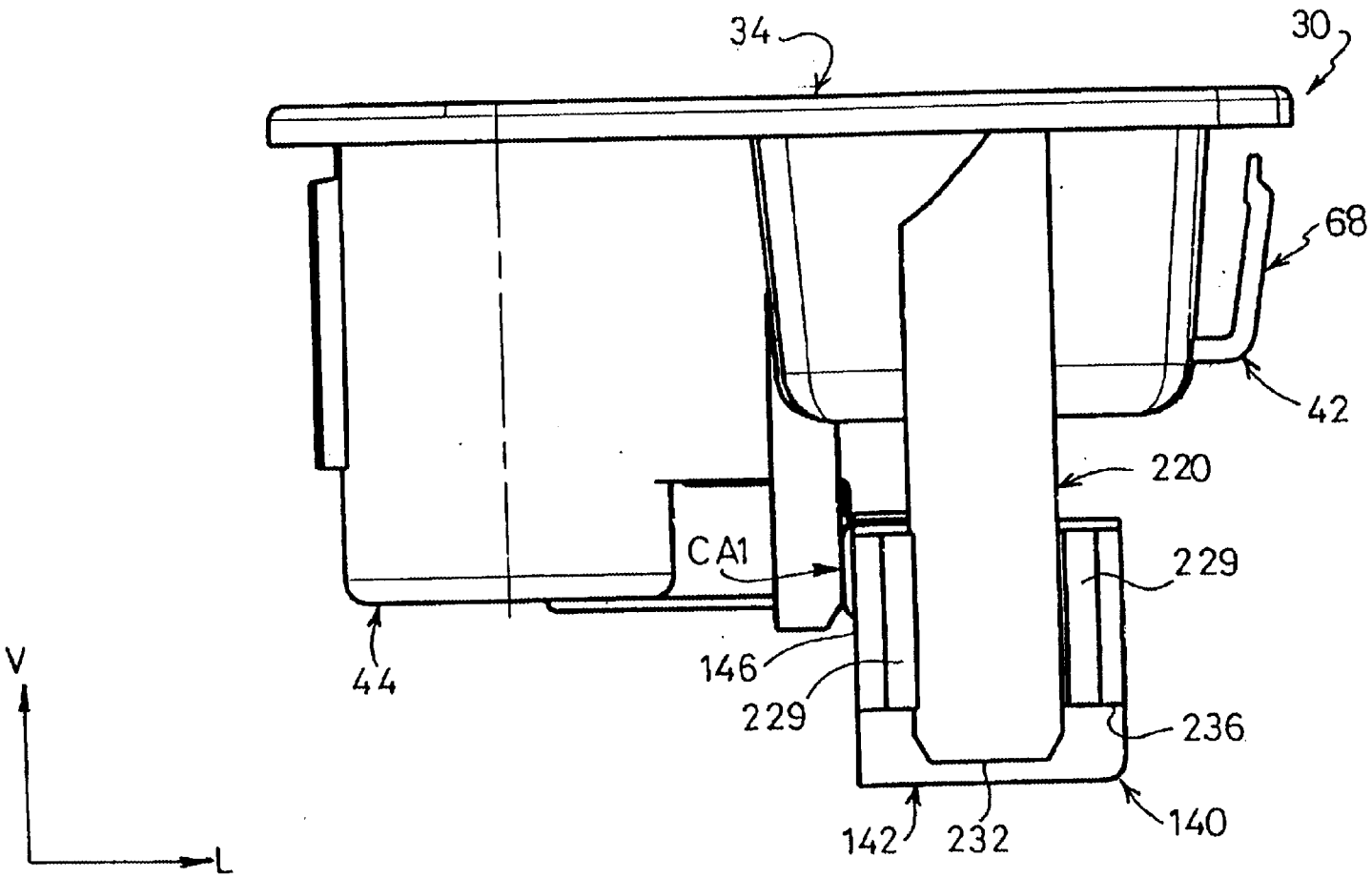
Figure 16:
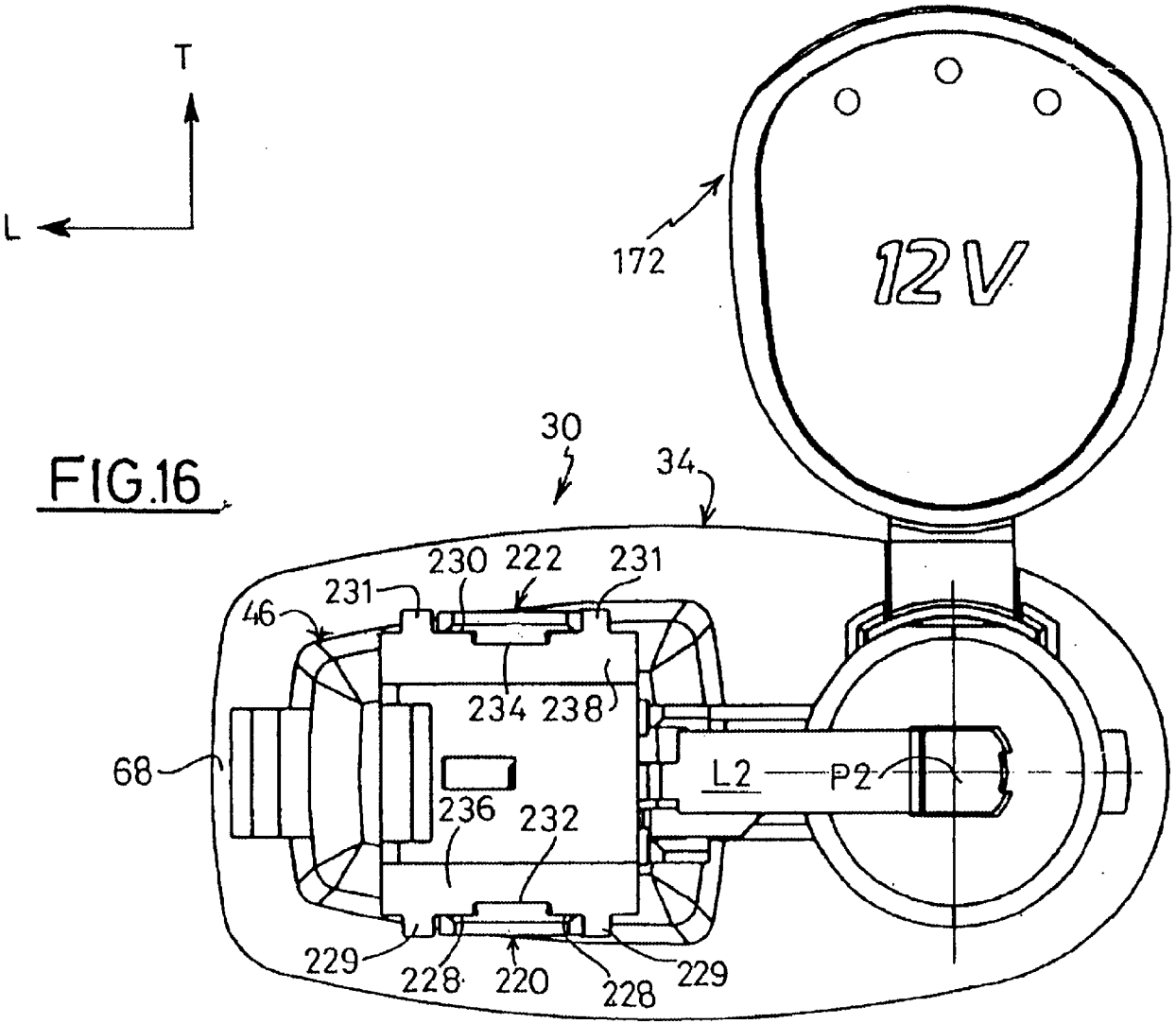
Figure 17:
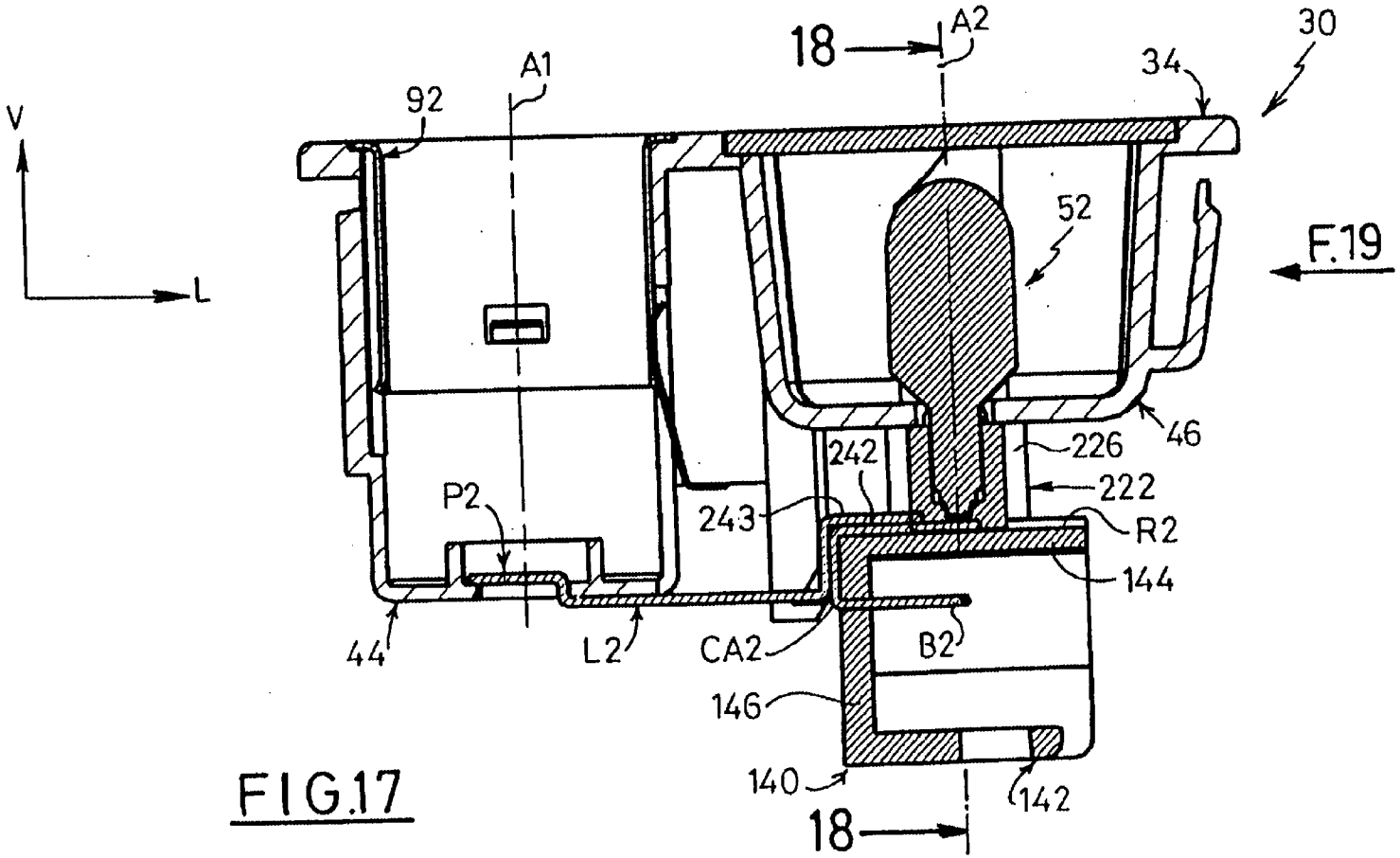
Figure 19:
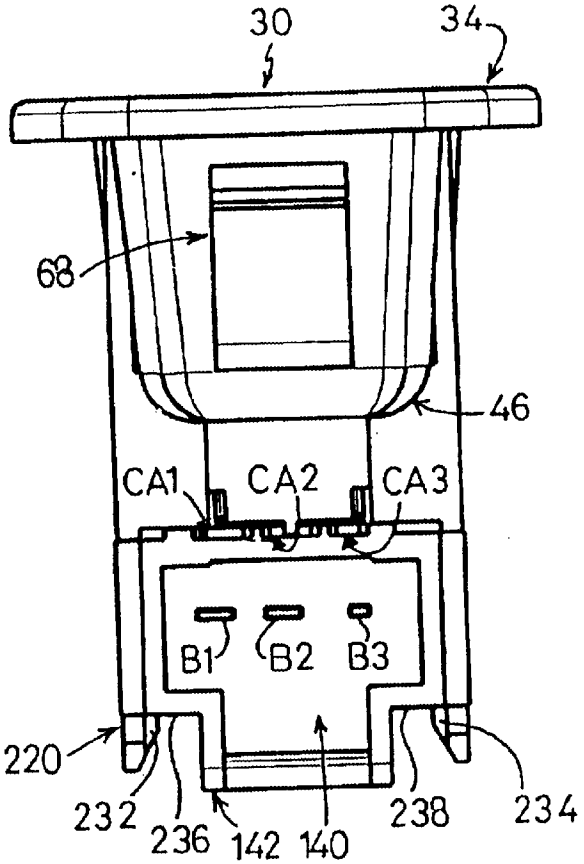
FIG. 19 is a longitudinal end-on view along the arrow F19 of FIG. 17.
Figure 18:
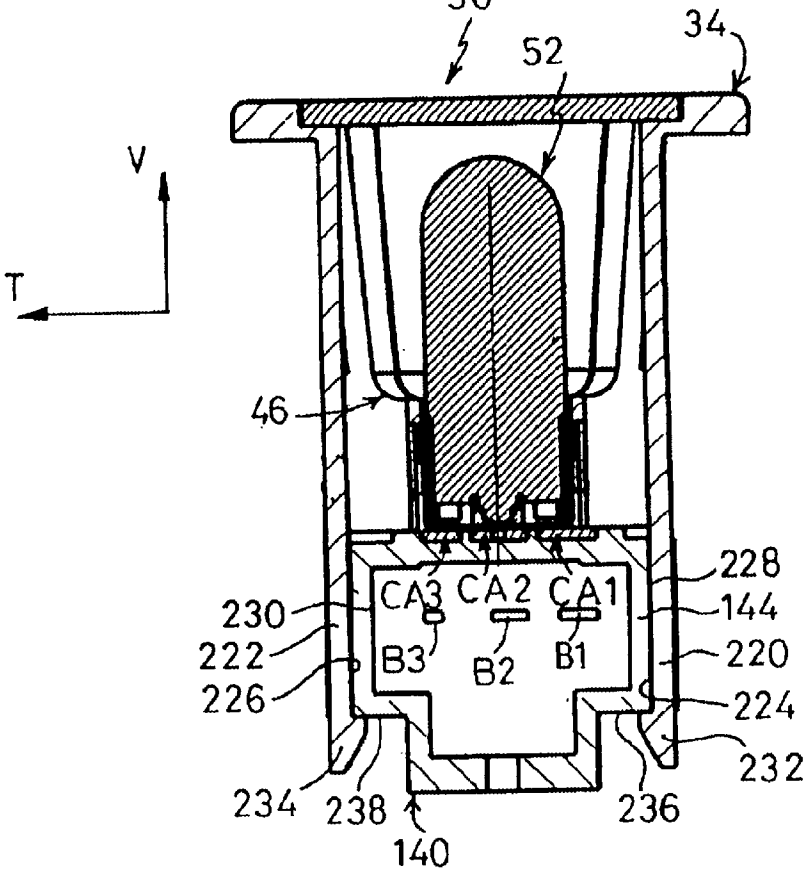

As can be seen in FIG. 5, as well as in FIGS. 13 and 19 relating to the third embodiment, the three pins B1, B2 and B3 are of horizontal, longitudinal orientation and are coplanar.

Thus the connector 140 with its insulating body 142 and its three pins form a common connector for the connection of the electrical power outlet 30 incorporating a lamp 52, according to the teachings of the invention, this common connector comprising a common pin B1 for the connection to earth of the outlet and of the lamp.

To complete the outlet according to the invention, it is possible to provide a transparent or translucent plate 170 for closing the opening 42 which is flush with the upper face 36 of the plate 34.

In a known manner, it is desirable, especially for aesthetic reasons, to close off the container 44 when the power outlet is not in use.

For this purpose, the invention proposes, in the first three embodiments, using an attached lid 172 which, in this case, is a cover made of a flexible material which comprises a body 174 capable of being accommodated, in the closed position, inside the sleeve 92 (see FIG. 5), the body being slightly compressed elastically and being retained in the sleeve by friction.

The lid 172 is attached to the plate 34 by means of an articulation tab 176 comprising a fold 178 forming a hinge, the tab 176 being fitted into a recess 180 formed in the lower face 38 of the plate 34 (see FIG. 3), being held therein by the interlocking of complementary shapes, the assembly of the tab 176 being "locked" when the product is in place in the cut-out 62 to the extent where it is imprisoned between the plate 34 and the part facing the upper face 63 of the panel 64.

Inscriptions, for example of voltage and power, may be produced by moulding the cover 172, or in the form of stickers affixed to the cover, or by deposition of paint, etc.

Figure 20:
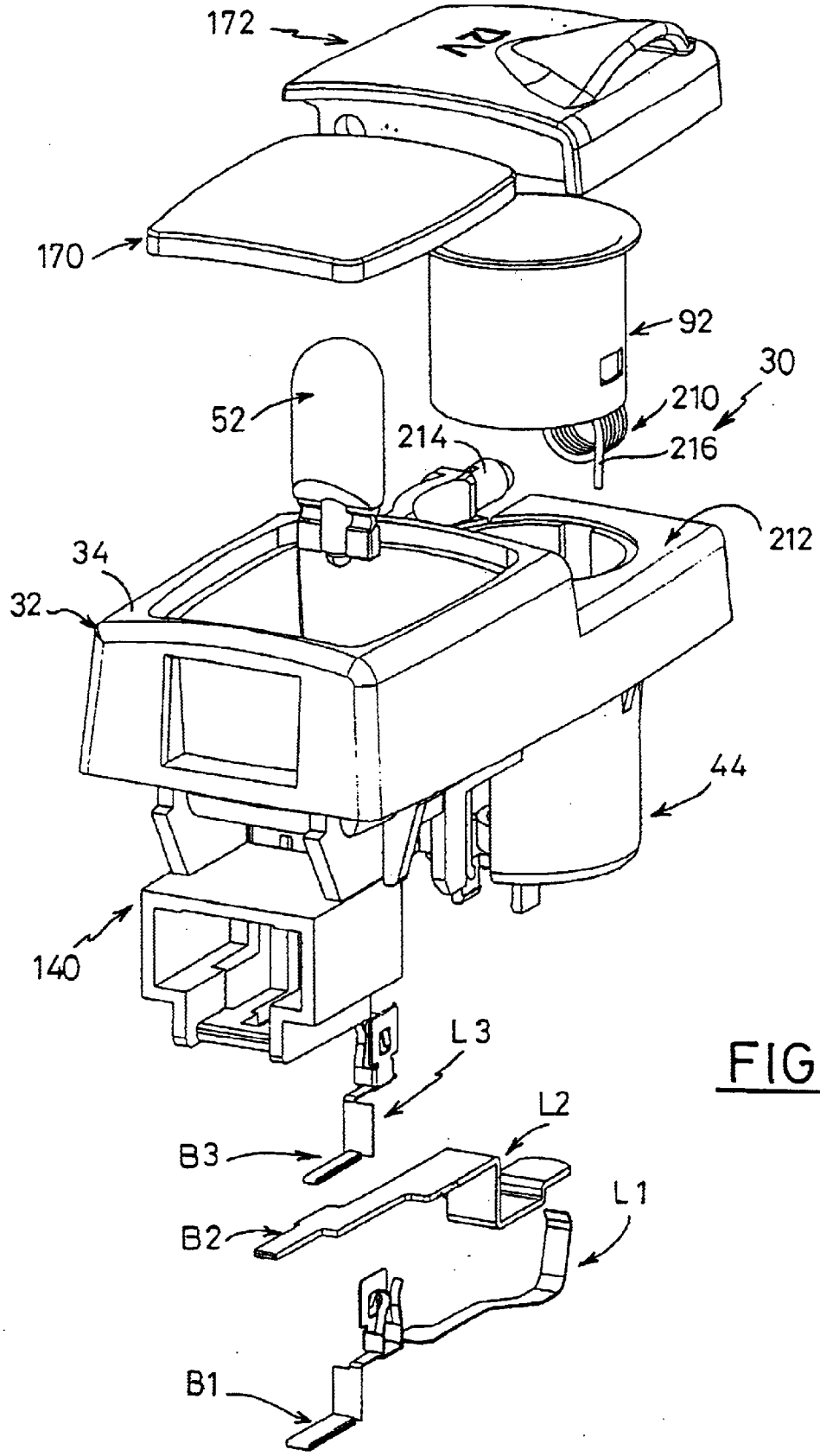
FIGS. 20 to 22 are views similar to those of FIGS. 1 to 3 which illustrate a variant embodiment of the lid for closing the container of the power outlet.
Figure 21:
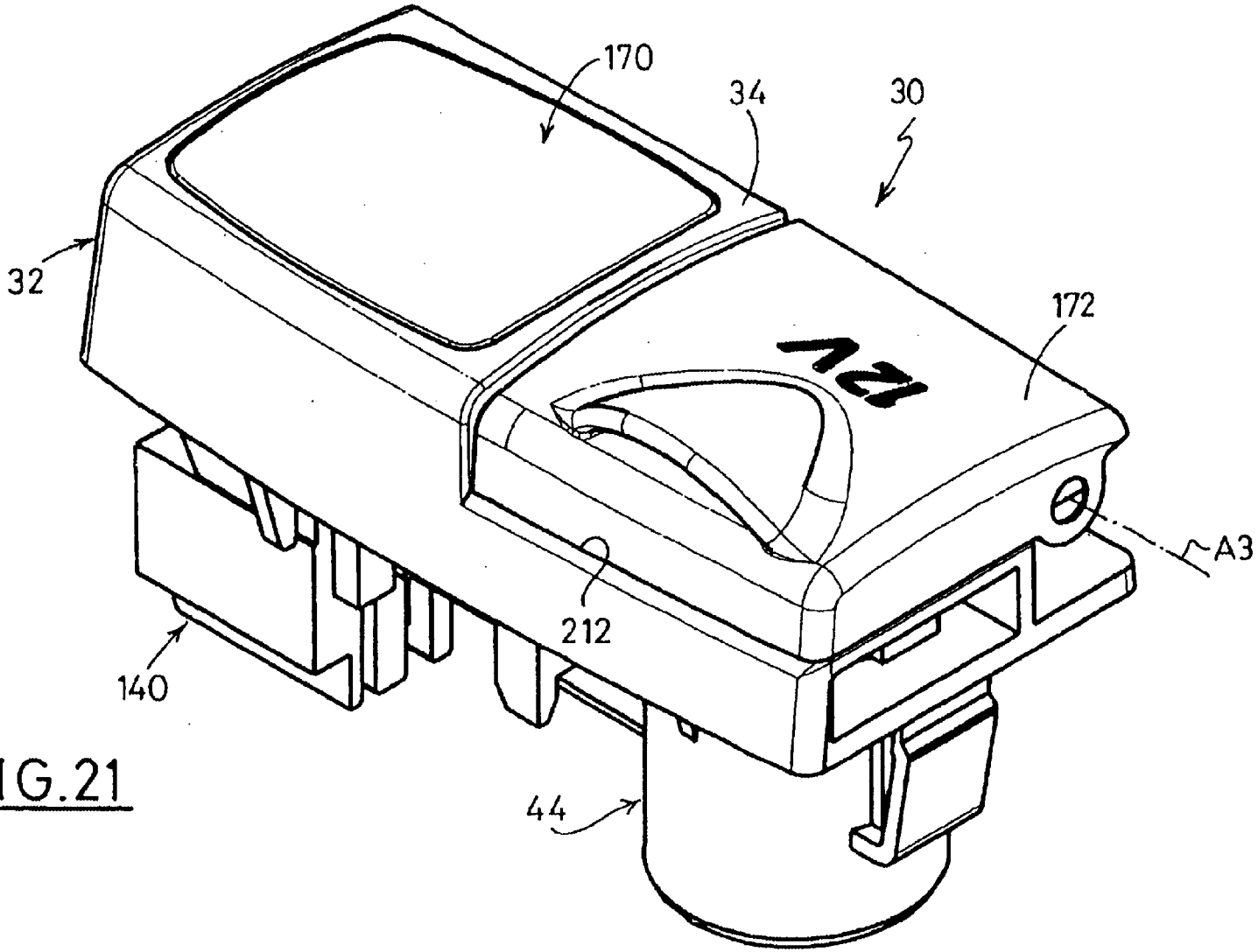
Figure 22:
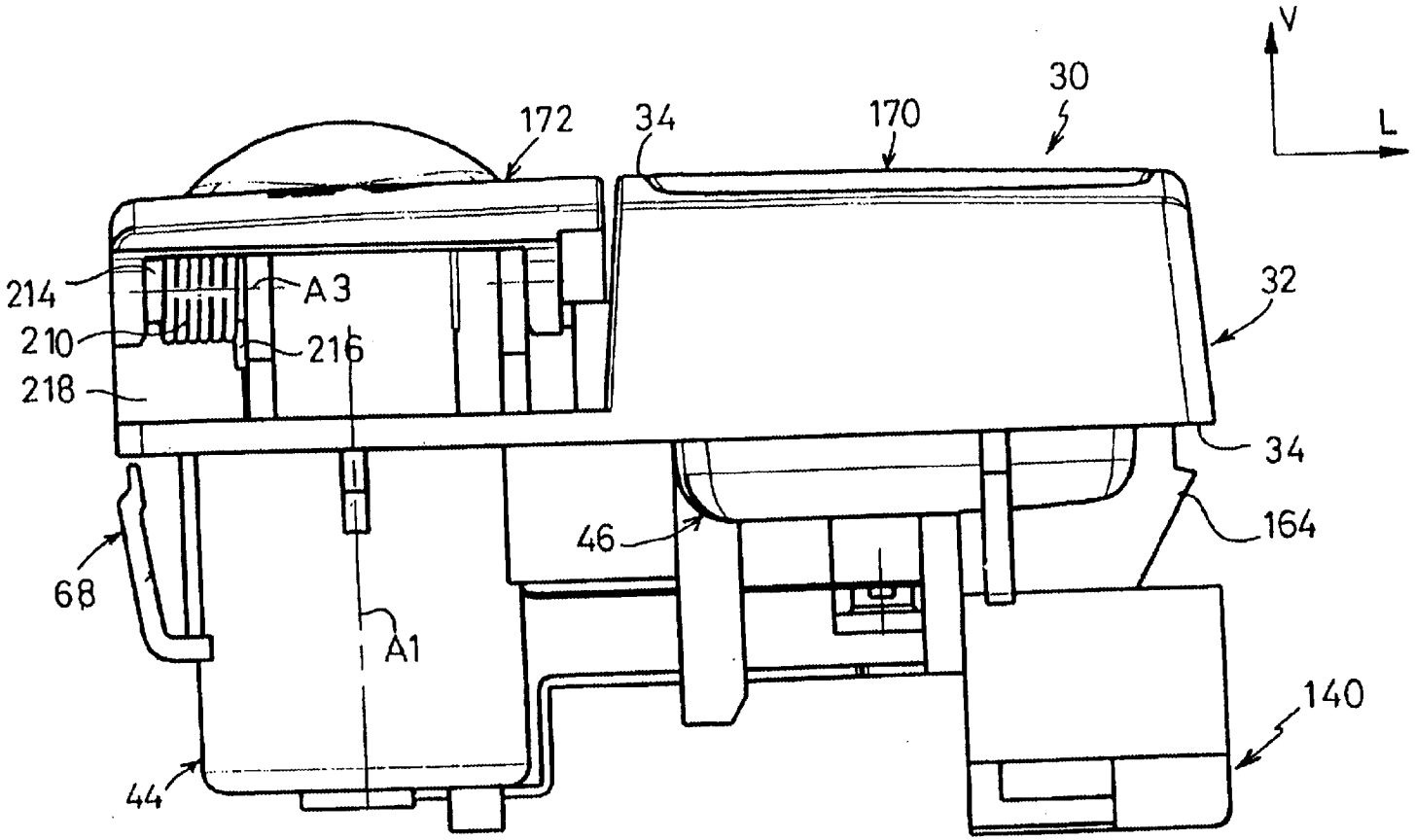

According to the variant embodiment shown in FIGS. 20 to 22, the lid 172 may be produced in the form of a rigid flap assembled articulated onto the plate 34 and which, in its closed position towards which it is returned elastically by a torsional spring 210 fitted around its articulation axis A3, lies in a horizontal plane flush with the upper face 36 of the plate 34, in the same way as the transparent plate 170 which closes the cavity 46, thus improving the aesthetic appearance of the assembly and preventing users from forgetting to re-close the lid 172 after use of the power outlet.

As can especially be seen in FIGS. 20 to 22, the upper face 36 of the upper plate 34 comprises an opening 212 which accommodates the articulated flap 172 in the closed position.

The spring 210 is mounted on a pivot 214 produced integrally with the plate 32 and its vertical 216 and horizontal (not visible in the figures) end strands bear respectively on a rear facet 218 of the insulating body and in a housing under the inner face of the flap 172 in order to urge the flap 172 permanently in the closed horizontal position bearing on the upper face of the opening 212.

In the various embodiments illustrated in the figures, the general axis of the lamp 52 and of the cavity 46 which accommodates it is a vertical axis A2 parallel to the axis A1 of the container 44 such that the light flux supplied by the lamp 52 is generally directed vertically upwards, with reference to the figures.

The invention is not limited to this design, it being possible for the illumination device to have an axis A2 in a different orientation, forming an angle with respect to the axis A1 of the outlet, for example horizontal. The assembly 30 may, for example, then be placed on the side of a rear shelf of the passenger compartment of the vehicle and be accessible to the rear passengers while providing illumination for the boot.

The second embodiment illustrated in FIGS. 7 to 12, which differs from the first embodiment in that it comprises an integrated switch for controlling the lamp, will now be described.

For this purpose, a switch 190 of overall known design with a control button 192 in its upper face is assembled by elastic interlocking in a complementary opening 194 formed in the upper plate 34, between the container 44 and the cavity 42, the length of the plate being, for this purpose, greater than in the first embodiment.

The body 196 of the switch extends vertically below the plate 34 with its two terminals 198 and 200 which extend vertically in the space between the container 44 and the cavity 42.

In order to control the supply to the lamp 52, by means of the switch 190, the electrical connection strip L3 is made in two parallel sections L3G and L3D.

The section L3D comprises the pin B3 and, at its rear longitudinal end, a tab bent in the vertical direction 202 which comprises at its free end a contact patch 204 which, in the assembled position of the switch 190, bears elastically against the terminal 200.

The section L3G has an overall design similar to that of the strip L3 of the first embodiment, with the pair of poles P3 and the dog 130, while its rear longitudinal end is extended by a vertical tab 206 and a contact patch 208 which, in the mounted position, bears elastically against the terminal 198.

The assembly consisting of the two sections L3G and L3D and the switch 190 thus provides electrical continuity between the poles P3 and the terminal B3, which may be interrupted when the switch 190 is open.

The means of attaching the outlet 30 are, in this case, simplified, that is to say that they only comprise the ribs 164 and the tab 68 in the absence of the system consisting of the clip 76 and the notches 78 and 80 provided in the first embodiment.

The third embodiment illustrated in FIGS. 13 to 18 will now be described, an embodiment which differs from the first embodiment by the design of the common connector 140 which in this case is produced in a modular form in order to provide an insulating body 32 for the outlet 30 which is a standard component and with which is associated a connector 142, the shape and the dimensions of the body 142, and of the U-shaped clips CA1, CA2 and CA3 of which may be modified according to the model of the vehicle which accommodates the power outlet 30.

For this purpose, the body 142 is a part moulded from insulating plastic independently of the body 32, with shapes which overall are similar to those of the first two embodiments.

In order to attach the body 142 under the cavity 46, the insulating body comprises two vertical arms 220 and 222 which extend along the longitudinal faces of the lateral wall 54 of the cavity, vertically below the latter, with mutually facing inner faces 224 and 226 of vertical and longitudinal orientation which are provided in order to accommodate the corresponding faces 228 and 230 of the body 142 between them, the arms 220 and 222 thus being accommodated vertically in two vertical slideways formed in the body 142.

Each slideway thus consists of the face 228, 230 associated with two vertical ribs 229, 231.

In the vertical direction, the body 142 is attached by two lips or hooks 232 and 234 which, in the assembled position of the body 142, are accommodated under the lower faces 236 and 238, of horizontal orientation, of the body 142 (see FIGS. 15, 16, 18 and 19).

The upper face 145 of the upper horizontal partition 144 of the insulating body 142 of the connector 140 comprises three longitudinal grooves R1 to R3 which accommodate the upper horizontal arms belonging to three metallic U-shaped clips CA1, CA2 and CA3, the longitudinal lower arms of which form the pins B1, B2 and B3, respectively.

The three U-shaped clips are mounted in the body 142 so that the three pins B1, B2 and B3 project inside the insulating body passing through slots formed in the rear transverse partition 146 thereof.

According to another design (not shown), the body 142 may be overmoulded around the three U-shaped clips CA1 to CA3.

The free upper faces 240, 242 and 244 of the upper arms of the three U-shaped clips CA1 to CA3 form contact surfaces for connecting each U-shaped clip with the associated connection strip L1 to L3, the front longitudinal end of which is shaped for this purpose.

In this design, the strips L1 to L3 are components which are standardized with respect to the power outlet 30 in order to form a common component, only the connector 140 with its U-shaped clips CA1 to CA3 may be of different shapes and dimensions depending on the model.

In order to come into contact with the upper faces 240, 242 and 244, the three strips L1 to L3 thus each comprise a horizontal arm 241, 243 and 245 which are coplanar, the contacts being established by slight elastic deformation, vertically upwards, of the tabs 241, 243 and 245 when the body 142 is elastically interlocked between the arms 220 and 222.

What is claimed is:

1. An electrical device for connecting an illumination lamp to an electrical circuit of a motor vehicle, said electrical device of the type comprising a body made of an insulating material which comprises a cavity for the illumination lamp and which bears means for electrically connecting the lamp to the electrical circuit of the vehicle, wherein the insulating body comprises a cylindrical container of a vertical axis containing a power outlet for connecting to an electrical circuit of the motor vehicle, and an appliance or an accessory not being an illumination lamp, said appliance or said accessory comprising a male plug which is the complement of the outlet, wherein the cylindrical container is capable of accommodating the male plug in a complementary way, and wherein the insulating body bears means for electrically connecting the power outlet to an electrical power circuit of the vehicle.

2. An electrical device according to claim 1, wherein the device comprises an integrated switch for controlling the lamp.

3. An electrical device according to claim 1, wherein the device comprises an articulated lid for closing the container.

4. An electrical device according to claim 1, wherein the container of the insulating body is internally lined with a fixed contact sleeve and bears a first conducting strip which connects the sleeve to a first pin of a connector; the insulating body bears a fixed contact pad arranged at the center of the container and a second conducting strip which connects the central contact pad to a second pin of a connector; the bottom of the cavity comprises a socket with two opposite poles, which accommodates the cap of the lamp; and the insulating body bears two conducting strips which connect the two poles of the socket to two pins of a connector.

5. An electrical device according to claim 4, wherein each pin of the connector consists of a free end of the associated conducting strip.

6. An electrical device according to claim 4, wherein the device comprises a common connector for connecting the outlet and the lamp.

7. An electrical device according to claim 6, wherein the pins of the common connector are borne by an insulating support attached to the insulating body.

8. An electrical device according to claim 6, wherein the pins of the common connector are borne by an insulating support made in a single piece with the insulating body.

9. An electrical device according to claim 8, wherein each connector pin is borne by the insulating support attached to the common connector and is electrically connected to a tab of the associated conducting strip.

10. An electrical device according to claim 4, wherein the insulating body is a part moulded from plastic which incorporates the container and the cavity.

11. An electrical device according to claim 10, wherein the insulating body comprises means of positioning and fastening the conducting strips.

12. An electrical device according to claim 11, wherein the insulating body comprises an upper horizontal plate for assembling the outlet into which the container opens.

13. An electrical device according to claim 12, wherein the cavity comprises an open face, away from said bottom, through which the light flux from the lamp emerges.

14. An electrical device according to claim 12, wherein the cavity comprises an open face away from said bottom through which the light flux from the lamp emerges and wherein the open face of the cavity opens out into the assembly plate of the insulating body.

15. An electrical device according to claim 12, wherein the outlet comprises a lid including an articulated closing flap, held elastically in the closed position in which the flap lies substantially in the plane of the upper assembly plate.

16. An electrical outlet device according to claim 6, wherein the common connector is a three-pin connector; the first conducting strip connects one of the poles of the socket to the first pin of the common connector; and the insulating body bears a third conducting strip which connects the other pole of the socket of the lamp to a third pin of the common connector.

17. An electrical device according to claim 16, wherein the outlet comprises an integrated switch for controlling the lamp and wherein the third strip is made in two sections between which the switch is inserted.

* * * * *